US006574343B1

(12) United States Patent
Meier

(10) Patent No.: US 6,574,343 B1
(45) Date of Patent: Jun. 3, 2003

(54) HEARING AID

(75) Inventor: Hilmar Meier, Männedorf (CH)

(73) Assignee: Phonak AG, Stafa (SE)

( * ) Notice: Subject to any disclaimer, the term of this patent is extended or adjusted under 35 U.S.C. 154(b) by 0 days.

(21) Appl. No.: 09/654,337

(22) Filed: Sep. 1, 2000

Related U.S. Application Data

(63) Continuation of application No. PCT/CH99/00093, filed on Mar. 1, 1999.

(30) Foreign Application Priority Data

Mar. 2, 1998 (EP) ..... 98103587

(51) Int. Cl.[7] ..... H04R 25/00

(52) U.S. Cl. ..... 381/322; 381/325; 381/328; 381/330

(58) Field of Search ..... 381/322, 330, 381/71.7, 91, 23.1, 312, 324, 325, 328, 329, 359, 355, 300

(56) References Cited

U.S. PATENT DOCUMENTS 3,265,153 A * 8/1966 Burroughs
4,041,251 A * 8/1977 Kaanders
4,051,330 A * 9/1977 Cole
4,073,366 A * 2/1978 Estes
4,122,015 A * 10/1978 Oda
4,600,077 A * 7/1986 Drever
4,987,597 A * 1/1991 Haertl
5,204,917 A * 4/1993 Ardnt
5,249,234 A * 9/1993 Butler
5,530,763 A * 6/1996 Aebi
5,790,672 A * 8/1998 Klostermeier
5,889,874 A * 3/1999 Schmitt

FOREIGN PATENT DOCUMENTS

DE 42 05 376 C1 9/1993
DE 296 23 264 U1 2/1998
EP 0 499 699 A1 8/1992

* cited by examiner

*Primary Examiner*—Curtis Kuntz
*Assistant Examiner*—Dionne N. Harvey
(74) *Attorney, Agent, or Firm*—Pearne & Gordon LLP

(57) ABSTRACT

The invention relates to a hearing aid comprising an acoustic input aperture (SE) and an acoustic output aperture (SA), and a cover element (DE) covering the acoustic input aperture (SE). In the invention, the cover element (DE) is received in the hearing-aid housing and its surface is flush with that of said housing and said cover element is made of an open-pore material. The invention offers the advantage that on account of integrating the cover element (DE) into the hearing aid, spurious acoustic signals caused by air motion cannot arise at the hearing aid.

15 Claims, 4 Drawing Sheets

HEARING AID

CROSS-REFERENCE TO RELATED APPLICATION

Figure 1:
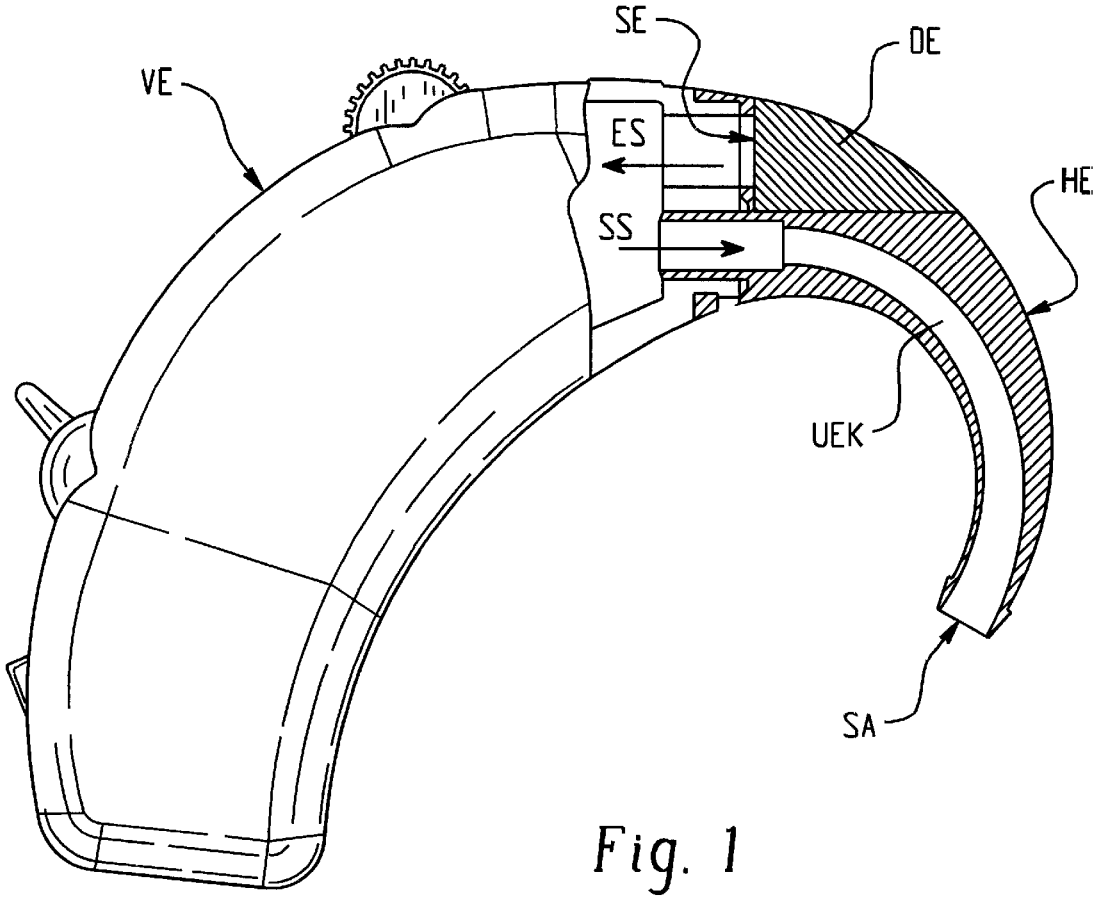

The present application is a continuation of International Application No. PCT/CH99/00093 filed on Mar. 1, 1999.

The present invention relates to a hearing aid defined in the preamble of claim 1.

Hearing aids comprise an acoustic input aperture to receive ambient sounds and an acoustic output aperture to emit the ambient sounds that were processed processed in the hearing aid. It is of foremost importance that spurious acoustic signals—which subsequently would be processed as being ambient sounds—should not be superposed on these ambient sounds. Spurious acoustic signals may arise from airflows detaching off edges or in the vicinity of the hearing aid (detachment problems) or from airflows of different speeds and/or directions in the immediate vicinity of the microphone membrane which would cause this membrane to move (gradient problems). These two sources of spurious acoustic signals also may be encountered in combination.

The U.S. Pat. No. 4,073,366 describes a cover element which is bonded across the acoustic input aperture of a hearing aid. This known cover element of several layers bonded together at their edges consists of a porous material, its purpose being to preclude spurious acoustic signals generated by airflows detaching off the edges of the said input aperture.

It was found however that this known design only little affects the majority of the spurious acoustic signals: even though the cover element across the acoustic input aperture does reduce gradient-induced spurious acoustic signals, it fails to affect detachment noises. The reason is that the cover element mounted across the acoustic input aperture to reduce flow detachment by its own edges gives rise to likely new sources of spurious acoustic signals. In this design the source of interfering spurious acoustic signals only has been shifted.

Reference is made for the sake of completeness to the European patent document 0,310,866 which discloses covering the acoustic output aperture with a preferably microporous cover element to prevent ear wax from penetrating the hearing aid. Said document also discloses covering the acoustic input aperture with a cover element in case an in-ear hearing aid is involved because in such a case ear wax only might penetrate the hearing aid when latter is inside the ear. Steps minimizing noise interference cannot be inferred from this document which merely concerns the prevent of hearing-aid soiling.

Accordingly it is the objective of the present invention to create a hearing aid reducing the generation of spurious acoustic signal.

This problem is solved by the features of claim 1. The further claims address advantageous embodiment modes of the invention.

The invention offers the following advantages: Edges that would be sources of spurious acoustic signals are avoided by integrating at least one cover element into the hearing aid proper and in this manner the detachment problem has been met. At the same time the gradient problem also is solved in that the cover element is made of an open-pore material and assumes a given thickness.

It was found that an open-pore polyethylene is especially well suited as the cover element material. The material properties may be characterized on one hand by the filter fineness corresponding to the minimum particle size of the filtered particles and on the other hand by the open-pore ratio of the material, i.e. the ratio of pore apertures to residual surface. The filter fineness is stated in d50 values approximately, at which 50% of the particles pass the filter and 50% of them are retained by it. It was found that the d50 values are between 10 and 200$\mu$ as regards filter fineness and the open-pore ratio is between 0.70 and nearly 1.00.

Because a homogeneous material is used for the cover elements, they are also highly reproducible because material discontinuities, which might degrade the acoustic properties of the overall system, are absent, since changes in material hold the danger of deviations from the normal acoustic behavior. Moreover both the manufacture and the installation of the cover elements of the invention into hearing aids is substantially simpler and hence also more economical.

In an embodiment variation of the invention, the homogeneously constituted cover elements are coated with a thin and permeable layer for instance of Teflon. Higher resistance is achieved thereby and is highly significant especially as regards external chemical factors. However the detachment problem also is taken into account because the coating imparts a finer surface to the cover element. In this manner spurious, acoustic detachment signals generated by roughnesses in the cover element surface are further minimized.

The invention is elucidated in illustrative manner in relation to the drawings.

Figure 2:
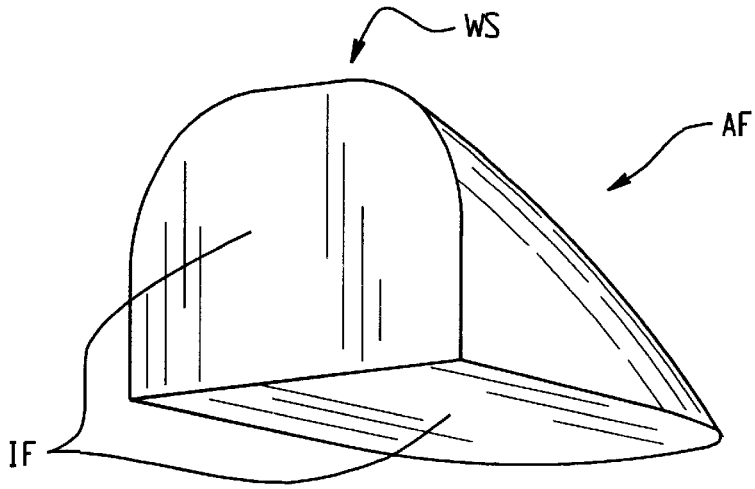
Figure 3:
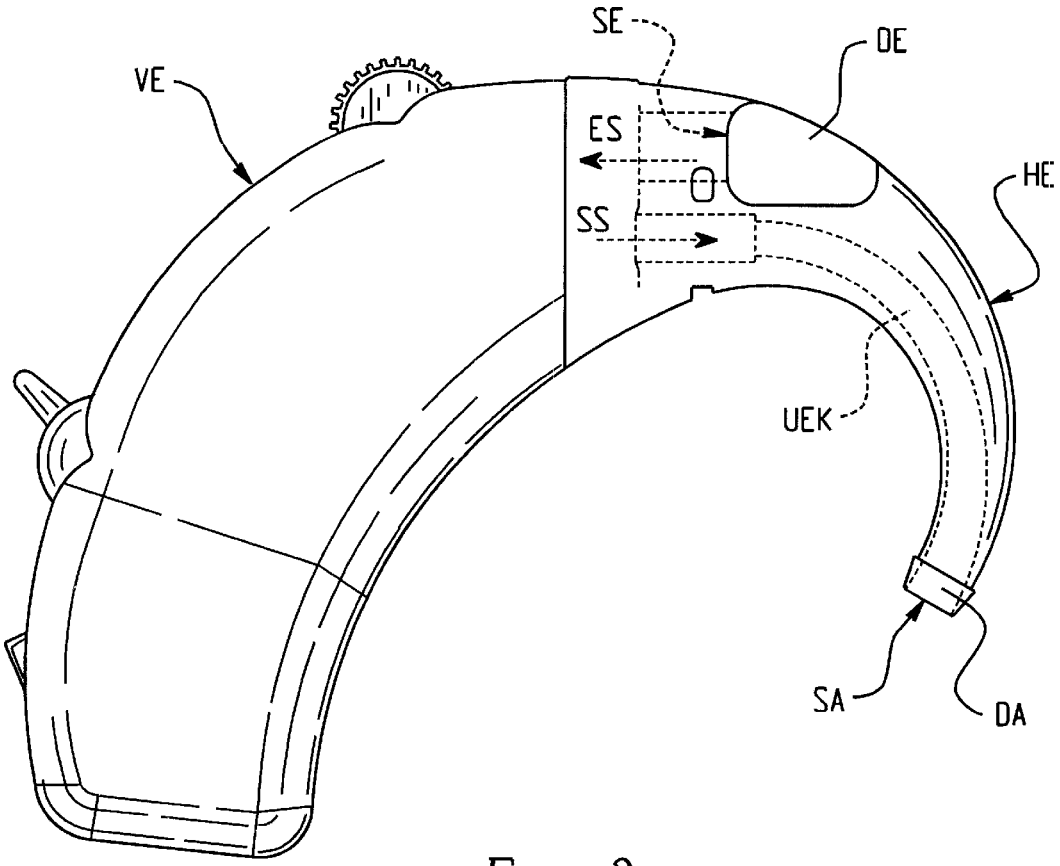
Figure 4:
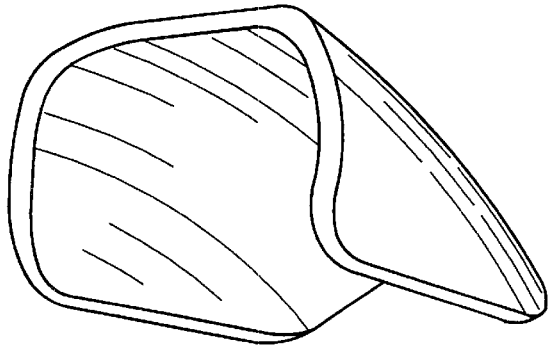
Figure 5:
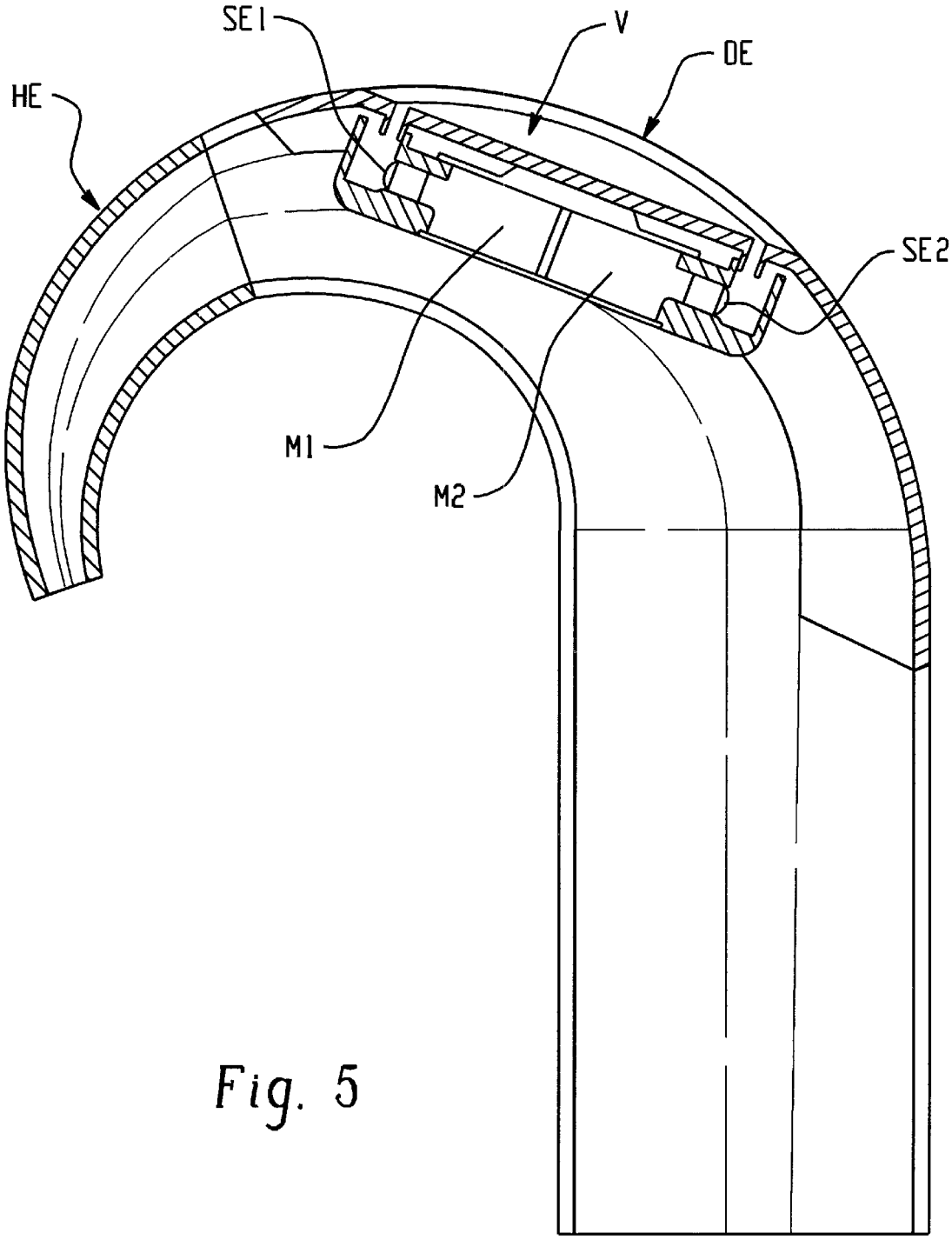
Figure 6A:
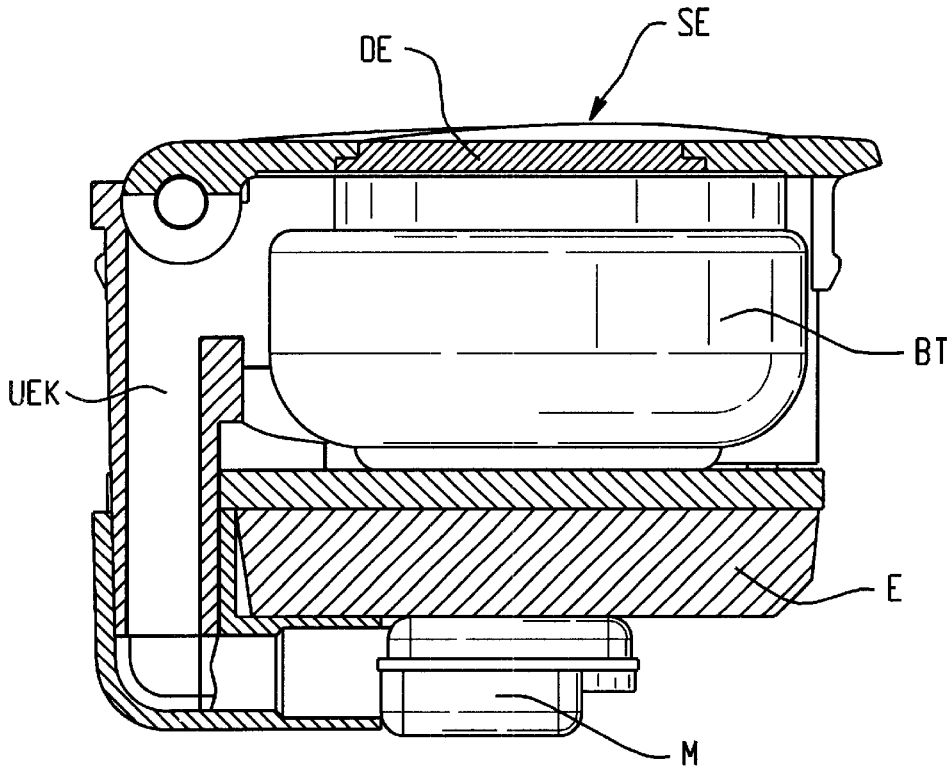

FIG. 1 is a longitudinal section through parts of a hearing aid of the invention with inserted over element, FIG. 2 is a perspective of the cover element of FIG. 1, FIG. 3 is a sideview of another embodiment of a hearing aid of the invention with inserted cover element, FIG. 4 is a perspective of the cover element of FIG. 3, FIG. 5 is a longitudinal section of a hearing aid of the invention comprising several microphones, and FIGS. 6*a,* 6*b* are a section and a topview resp. of an in-ear hearing aid fitted with a cover element of the invention.

FIG. 1 shows a longitudinal view of a hearing aid of the invention consisting of an amplifier VE and a hook HE. The hook HE is detachably connected to the amplifier VE, that is, the hook HE or the amplifier VE may be arbitrarily exchanged or replaced.

The amplifier VE substantially electronically processes the acoustic signals (see arrow ES) which, following processing, are transmitted to the hook HE (see arrow SS), i.e. to an acoustic transmission duct UEK contained therein. The hearing-aid's amplifier VE need not be elucidated herein because the objective of the invention foremost is the design of the hook HE.

It is emphasized however that the invention is not restricted to hearing aids consisting of two parts, namely an amplifier VE and a hook HE. Instead the invention also applies particularly to hearing aids consisting of a single housing part. Moreover the invention applies as well to in-ear hearing aids as to behind-the-ear hearing aids.

As regards the present invention, the external shape of the amplifier will be significant. In particular in the transition zone between the amplifier VE and the hook HE—again as regards the embodiment of FIG. 1—these two components comprise, if not identical, at least similar contours and surface properties. The hearing aid of the invention as a whole is free of sharp edges to preclude generating spurious sounds.

Preferably the hook HE is free of electronic components, in particular to it be capable to receive ambient sounds in the most interference-free manner and to transmit them in the direction of the arrow ES into the amplifier VE. On the other hand, the processed acoustic signals are transmitted in the direction of the arrow SS through the acoustic transmission duct UEK in the hook HE to an acoustic output aperture SA where the acoustic signals reach the hearing-aid wearer's auditory canal.

The invention provides a cover element DE in the hook HE which covers the zone o the acoustic input aperture SE relative to the ambient, the cover element DE being integrated in such manner into the hook HE that edges at the transition sites between the hook HE and the cover element DE shall not project, that is, the cover element DE is integrated into the hook so that their two surfaces shall be flush. Moreover the cover element DE is externally spherical or at least spherical in parts. In this manner the hearing aid is free of edges that might generates spurious acoustics.

As already mentioned above, the materials used for the cover elements are porous, preferably being open-pored in a manner defined by the two parameters of filter fineness and open-pore ratio. Also the material used in the invention in one embodiment mode is homogeneous in structure.

It was found that especially good results will be attained if the said material is of a filter fineness between 10 and 200$\mu$ (given in d50 values) and has an open-pore ratio between 0.70 and nearly 1.00. However the selection of these parameters and especially of filter fineness is significantly affected by the cover element's thickness, i.e. by its volume. It was found in this respect that the largest possible volume of a cover element is advantageous in reducing the gradient effect. On the other hand a volume increase at the same time changes in undesired manner the acoustic impedance. Therefore a tradeoff must be found between these two optimization conditions, as shall be elucidated further below in relation to FIG. 2.

The following materials are especially appropriate for this invention: sintered polymers, polyethylene, foam ceramics (also: ceramic foam), foamed polyurethane, sintered glass or sintered metal.

As already mentioned above, the cover element is made of a homogeneous material. A further implementation of the invention proposes to coat the cover element's outside with a thin, fine-pored layer. Preferably such a layer shall consist of Teflon. Such a layer offers the advantages of increasing chemical resistance and thereby the hearing aid of the invention can be used under adverse ambient conditions. While repelling water, body sweat and body fat is necessary and demanded for the daily use of hearing aids, special storage conditions conceivably will also require repelling other chemicals and make such an additional feature desirable.

Resistance to weather is of great importance when using hearing aids daily and can be achieved by using a hydrophobic cover element or at least hydrophobing the surface, or coating it with a hydrophobic material.

FIG. 2 is a perspective of the cover element DE for the hearing aid of the invention of FIG. 1. Said cover element comprises an outwardly directed surface AF and inwardly directed surfaces IF. The division of the surface AF into three areas merely serves to indicate the surface curvatures and otherwise implies no significance. The same consideration applies to the four inward partial surfaces of the inwardly surface IF.

Because of its large volume, the cover element DE shown in FIG. 2 offers good behavior as regards the gradient effect. However this large volume also entails limitations regarding the acoustic impedance properties of the hearing-aid's unit. The latter drawback can be countered by selecting a fine pore structure preferably at 80 to 100$\mu$ (d50 values).

As does FIG. 1, FIG. 3 shows a longitudinal section of the hearing aid of the invention, those components already used in the hearing aid of FIG. 1 also being denoted by the same references in FIG. 3.

As shown by FIG. 3, the cover element of this embodiment is rounded off in the edge zones. The clearance in the hook HE receiving the cover element DE has been matched to the latter's external shape. This embodiment of the invention offers the additional advantage of a more compact and more dimensionally stable design than attained in the embodiment variation of FIG. 1: In the present case, the cover element DE is so enclosed by the hook HE that the freedom of motion of this cover element DE is restricted radially. For its installation and removal, the cover element DE may be displaced perpendicularly to the plane of the drawing of FIG. 3.

FIG. 4 shows the cover element DE that may be inserted into the hearing aid of FIG. 3. Asides the differences already cited above relative to the embodiment of FIGS. 1, 2, the cover element DE of FIG. 4 is in the form of a shell, that is, while the outwardly directed surfaces remain unchanged, the volume of porous material is reduced. A filter fineness preferably between 10 and 40$\mu$ shall be selected for such a shell design, the shell's thickness being at least 0.5 mm.

Lastly FIG. 5 shows a hearing-aid embodiment using two microphones M1 and M2 to control the directional characteristics. In this invention, the two microphones M1 and M2 are mounted under the same cover element DE. The cover element DE is in the form of a shell and subtends a volume V fitted with acoustic input apertures SE1 and SE2 near a respective microphone M1 and M2.

It is well known, when using several microphones to control the directional characteristics, that matching the two microphones is critical. This matching is best attained in that the two microphones M1 and M2 shall be mounted under the same cover element DE, whereby the volumes V in front of the microphones also shall be identical. Unavoidable soiling of the outwardly directed surface of the cover element DE will then equally affect the two microphones M1 and M2.

Figure 6B:
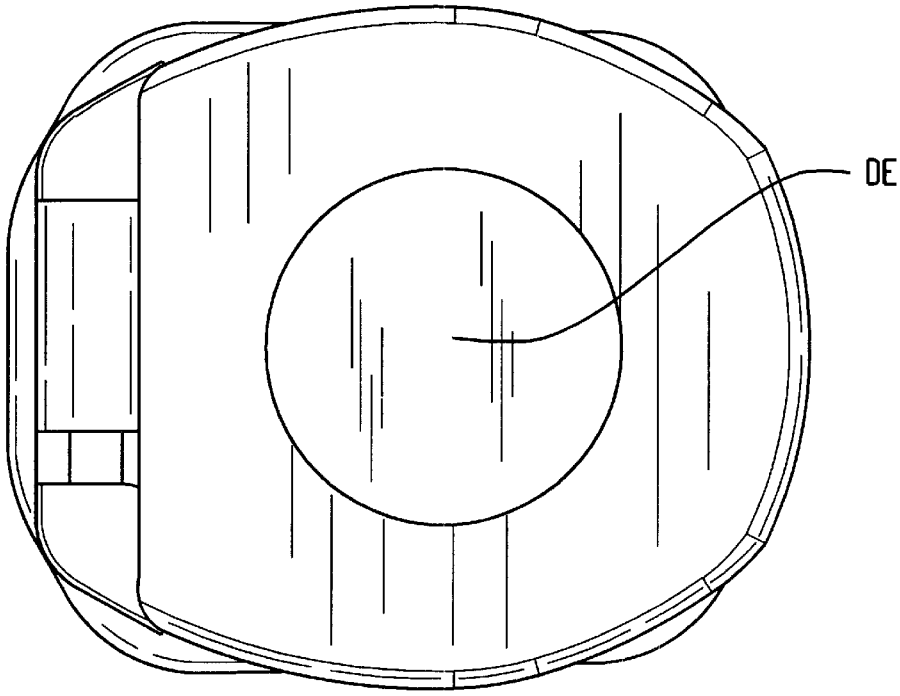

FIG. 6 shows an in-ear hearing aid, with FIG. 6A being a cross-section and FIG. 6B a topview. In FIG. 6A the cover element again is denoted by DE and covers an acoustic input aperture SE. An acoustic duct UEK also is shown which transmits sound waves to a microphone M. For the sake of completeness, FIG. 6A also shows a battery BT and a housing E containing the electronics.

The topview of FIG. 6B shows the cover element DE which in this embodiment preferably shall be a spherical segment.

Compared to the embodiments of FIGS. 1 through 5, the in-ear hearing aid design of FIG. 6 mostly differs by a different configuration of the hearing-aid components. However the principle of the invention remains unaffected thereby.

The above discussions concern hearing aids of which the acoustic input apertures are fitted with an appropriate cover element. In a further embodiment of the invention, the acoustic output aperture also shall be fitted with a cover element (DA). In this manner, the resulting hearing aid not only shall be optimal with respect to acoustic behavior but also and especially it shall be designed against all degrading external factors.

In this respect, cover elements for vents also are conceivable. Illustratively, when using zinc-air batteries, an air supply must be assured. The above discussed cover elements are eminently suitable for such purposes and in such an application the cover element shall be integrated preferably in surface-continuious manner into the hearing-aid unit.

What is claimed is:

1. A hearing aid with a housing and with an acoustic input aperture (SE) and an acoustic output aperture (SA), a cover element (DE) overlaying the acoustic input aperture (SE) and a material of the cover element (DE) permitting passage of substantially all of the sound received at the input aperture through the material of the cover element, characterized in that the cover element (DE) is integrated into the hearing-aid housing so that said element's surface is flush with an adjacent surface of the housing.

2. Hearing aid as claimed in claim 1, characterized in that it comprises a further cover element covering the acoustic output aperture (SA), the surface of said further cover element being integrated into the hearing-aid housing in such manner that the surfaces of said further cover element are flush with an adjacent surface of the housing.

3. Hearing aid as claimed in claim 2, characterized in that the acoustic output aperture (SA) and the further cover element are received in a hook (HE) which is detachably connected to an amplifier (VE).

4. Hearing aid as claimed in claim 2, characterized in that one of the cover element is detachably connected to the hearing-aid housing.

5. Hearing aid as claimed in claim 1, characterized in that the cover element (DE) is made of a sintered polymer, foam ceramics, sintered glass or sintered metal.

6. Hearing aid as claimed in claim 1, characterized in that the cover element is made of a material that is at least hydrophobic or oleophobic.

7. Hearing aid as claimed in claim 1, characterized in that the cover element (DE) is made of a filter fineness of 10 to 200$\mu$ and in that its open-pore ratio is between 0.70 and nearly 1.00.

8. Hearing aid as claimed in claim 1, characterized in that the cover element (DE) has a polytetrafluoroethylene layer on its outside.

9. Hearing aid as claimed in claim 1, characterized in that the structure of the cover element (DE) is homogeneous.

10. Hearing aid as claimed in claim 1, characterized in that the cover element (DE) is designed as a shell made of a material preferably of a filter fineness between 10 and 40$\mu$.

11. Hearing aid as claimed in claim 10, characterized in that the shell thickness is at least 0.5 mm.

12. Hearing aid as claimed in claim 1, characterized in that the cover element (DE) is a full body of which the material has a filter fineness between 80 and 100$\mu$.

13. Hearing aid as claimed in claim 1, characterized in that the acoustic input aperture (SE) and the cover element (DE) are received in a hook (HE) which is detachably connected to an amplifier (VE).

14. Hearing aid as claimed in claim 1, characterized in that at least two microphones (M1, M2) are configured under the cover element (DE) covering the acoustic input aperture (SE).

15. Hearing aid as claimed in claim 1, characterized in that the hearing aid housing is fitted with a vent assuring air supply to a zinc-air battery, said vent being covered by a further cover element which is integrated into said housing and of which the surface is flush with that of the housing.

* * * * *

UNITED STATES PATENT AND TRADEMARK OFFICE

CERTIFICATE OF CORRECTION

PATENT NO. : 6,574,343 B1
DATED : June 3, 2003
INVENTOR(S) : Hilmar Meier

It is certified that error appears in the above-identified patent and that said Letters Patent is hereby corrected as shown below:

Title page,
Item [73], Assignee, please delete "Stafa (SE)", and insert therefor -- Stafa (CH) --.

Signed and Sealed this

Thirtieth Day of December, 2003

JAMES E. ROGAN
*Director of the United States Patent and Trademark Office*